United States Patent [19]

Tomimatsu et al.

[11] Patent Number: 4,867,765

[45] Date of Patent: Sep. 19, 1989

[54] SELF-DISCHARGE TYPE PULSE CHARGING ELECTROSTATIC PRECIPITATOR

[75] Inventors: Kazutaka Tomimatsu; Yutaka Nakayama, both of Kobe, Japan

[73] Assignee: Mitsubishi Jukogyo Kabushiki Kaisha, Tokyo, Japan

[21] Appl. No.: 163,146

[22] Filed: Feb. 25, 1988

Related U.S. Application Data

[63] Continuation of Ser. No. 881,005, Jul. 1, 1986, abandoned.

[30] Foreign Application Priority Data

Jul. 1, 1985 [JP] Japan ..... 60-144184

[51] Int. Cl.[4] ..... B03C 3/02

[52] U.S. Cl. ..... 55/139; 323/903

[58] Field of Search ..... 55/105, 136, 139, 2; 323/903, 136

[56] References Cited

U.S. PATENT DOCUMENTS

| | | | |
|---|---|---|---|
| 1,959,374 | 5/1934 | Lissman | 55/139 X |
| 1,968,330 | 7/1934 | Wintermute | 55/139 X |
| 1,978,426 | 10/1934 | Hahn | 55/139 |
| 2,000,019 | 5/1935 | Heinrich et al. | 55/136 X |
| 2,000,020 | 5/1935 | Heinrich | 55/139 X |
| 2,016,531 | 10/1935 | Wintermute | 55/136 |
| 2,069,692 | 2/1937 | Wintermute | 55/139 X |
| 2,326,237 | 8/1943 | Lissman | 55/139 |
| 4,541,848 | 9/1985 | Masuda | 55/139 |
| 4,558,404 | 12/1985 | James | 55/105 X |
| 4,592,763 | 6/1986 | Dietz et al. | 55/105 X |

FOREIGN PATENT DOCUMENTS

| | | | |
|---|---|---|---|
| 61843 | 4/1983 | Japan . | |
| 143849 | 7/1985 | Japan . | |
| 152118 | 8/1985 | Japan . | |
| 936607 | 9/1963 | United Kingdom | 55/105 |

*Primary Examiner*—Bernard Nozick

*Attorney, Agent, or Firm*—Birch, Stewart, Kolasch & Birch

[57] ABSTRACT

A self-discharge type pulse charging electrostatic precipitator includes a high-speed switching element through which the electrical charge stored in a condenser is suddenly supplied to the electrostatic precipitator and the charge is dissipated in an internal resistance in the precipitator. A charging section of the electrostatic precipitator for one power source is divided into a plurality of charging sections which are coupled with each other through inductive elements. The electrostatic precipitator includes a device for supplying the electrical charge to each of the divided charging sections through the high-speed switching element successively in a time sharing manner and a charging capacitor having a capacitance which is substantially equal to a capacitance of the divided charging section. The electrostatic precipitator possesses enhanced precipitation efficiency by suppressing the back ionization and realizes reduction in cost of the power source.

2 Claims, 8 Drawing Sheets

SELF-DISCHARGE TYPE PULSE CHARGING ELECTROSTATIC PRECIPITATOR

This application is a continuation, of application Ser. No. 881,005 filed on July 1, 1986, now abandoned.

BACKGROUND OF THE INVENTION:

(i) Field of the Invention

The present invention relates to a self-discharge type pulse charging electrostatic precipitator and more particularly, to the electrostatic precipitator (hereinafter abbreviated as EP) applied to increase precipitation efficiency by suppressing back back ionization and realizing a cost reduction of the power source.

(ii) Prior Art Statement

A conventional EP adopts a negative direct current (DC) high voltage charging method. With this conventional EP, when high-resistive dust is processed, dielectric breakdown is caused in the dust layer on the electrode for precipitation and ions having the reverse polarity are produced, so that the precipitation efficiency is remarkably deteriorated, that is, the back ionization phenomenon occurs. The back ionization phenomenon is caused when the product $\rho d \times i$ of the electrical resistivity $\rho d$ of the dust and the current density i of the dust layer exceeds the dielectric breakdown voltage Edc of the dust layer.

Thus, a pulse charging system is proposed as means for obtaining high precipitation efficiency while suppressing the back ionization.

FIGS. 4(A) and (B) show an example of a pulse superposition type charging EP in which a pulse voltage is superposed on a high DC voltage, and FIGS. 5(A) and (B) show voltage waveforms of the circuit of FIGS. 4(A) and (B). A voltage stepped up by a transformer 1 is rectified through a rectifier 2 and is stored as the electrical charge in a charging capacitor 3. The circuit of FIG. 4 produces the LC resonance by a resonance circuit consisting of the charging capacitor 3, a coupling capacitor 6, a capacitance $C_{EP}$ contained in an EP 7 and an inductance of the circuit when a high-speed switching element 4 is turned on, and the electrical charge stored in the capacitor 3 is subjected to the LC resonance so that a high voltage having a sharp rising edge is supplied to the EP 7. The switching element 4 is turned off at the next instance, and at this time the charge remaining in the circuit is removed through a waveform shaping resistor 5 so that excessive current does not flow in the EP 7 due to the charge stored in the circuit. In this manner, a voltage having a sharp rising edge and short pulse width can be impressed on the EP 7 through the coupling capacitor 6 as shown in FIGS. 5(A) and (B). Further, in order to obtain a base voltage existing at the time except the occurrence of the pulse, a high DC voltage generator 8 is connected to the EP 7. With this method, the DC charging portion can impress the high peak voltage to the EP without increased average current at the pulse portion while suppressing current and hence the precipitation efficiency for high resistive dust is improved.

However, the above system requires two power sources and a coupling capacitor in addition to the charging capacitor, and hence the cost of the power source is very expensive. Accordingly, the system is not widely put to practical use.

An energy withdrawal type pulse charging system is proposed as another system. However, the system has a complicated power supply circuit and the cost of the power source is expensive.

Accordingly, there has been proposed a self-discharge type pulse charging EP as shown in FIGS. 6(A) and (B) in which the charging capacitor 3 is directly connected to the EP 7 through the high-speed switching element 4 with the coupling capacitor 6, the DC high voltage generator 8 and the waveform shaping resistor 5 being removed. FIG. 6B shows an electrical equivalent circuit of EP which consists of a parallel circuit of an equivalent capacitance $C_{EP}$ and an equivalent resistance $R_{EP}$. With this EP, when the switching element 4 is turned on, the electrical charge stored in an equivalent capacitance $C_{EP}$ of the EP 7 is discharged through an equivalent resistor $R_{EP}$ (resistance and the like by the corona discharge) in the EP. FIGS. 7(A) and (B) show voltage waveforms obtained from the circuits of FIGS. 6(A) and (B). The system is characterized in that a pulse voltage waveform having a sharp rising edge can be obtained economically and the uniform current density in the same manner as the prior art pulse charging system can be also obtained, and it has been confirmed by an experiment that the precipitation efficiency for the high resistive dust is improved as compared with the DC charging system.

In FIG. 6(A), a voltage stepped up by the transformer 1 is rectified through the rectifier 2 and is stored as the electrical charge in the charging capacitor 3. Thus, when the high-speed switching element 4 is turned on, the circuit of FIG. 6(A) produces the LC resonance by a resonance circuit consisting of the equivalent capacitance $C_{EP}$ of the EP 7, the charging capacitor 3 and the inductance of the circuit, and the electrical charge stored in the capacitor 3 is subjected to the LC resonance so that a high voltage waveform having high rising edge as shown in FIGS. 7(A) and (B) is obtained. After the switching element 4 is turned off, the electrical charge stored in the equivalent capacitance $C_{EP}$ of EP 7 is discharged through the equivalent resistance $R_{EP}$ of EP 7 and the voltage on the capacitance of EP 7 is gradually attenuated until the switching element 4 is turned on again. In this operation, a starting voltage when the attenuation of the voltage starts by the flow of current through EP 7 after the switching element 4 is turned off is named an attenuation starting voltage, and a lowest voltage just before the switching element 4 is turned on is named a residual voltage.

However, the conventional self-discharge type pulse charging system which is inexpensive has the following problems.

(1) Since the self-discharge type pulse charging system has only a single power source, if a peak voltage is increased in order to improve the efficiency thereof, the attenuation starting voltage and the residual voltage are also increased uniquely. Accordingly, current flowing through the EP is increased while the voltage is attenuated from the attenuation starting voltage to the residual voltage, and hence back ionization is caused for high resistive dust. In particular, since the current flowing through EP is increased in the manner of an exponential function with the increase of the voltage, large current flows in the vicinity of the attenuation starting voltage, thereby producing a critical condition of back ionization. FIG. 8 shows the relationship between the peak voltage and the precipitation efficiency obtained from an experiment made by the inventors. According to the experiment, it has been confirmed that the precipitation efficiency increases with the increase of the peak voltage and has a maximum valaue at a certain peak voltage, the efficiency being reduced above the certain peak voltage.

(2) While the precipitation efficiency is improved as the average voltage from the attenuation starting voltage to the residual voltage, as shown in FIGS. 7(A) and (B), (which corresponds to the average voltage of the so-called DC charging system in the prior art) is higher, it is necessary to shorten the cycle of the pulse shown in FIG. 7(A) in order to increase the average voltage at the period described above. However, in this case, if the cycle of the pulse is shortened excessively, the increase of the current flowing through the EP as corona current in the vicinity of the attenuation starting voltage causes back ionization.

(3) To the contrary, if the cycle of the pulse is enlarged to reduce the consumption energy, the average voltage is reduced.

(4) Further, the self-discharge type pulse charging system can reduce the cost greatly as compared with the conventional pulse charging system. However, in order to increase the capacity of the EP 7 for one power source, the charging capacitor having a large capacitance is required since the charging capacitor 3 is proportional to the equivalent capacitance $C_{EP}$ of the EP 7. Further, there are technical problems such as the voltage having a round rising edge by increased current flowing through the high-speed switching element and increased inductance contained in the circuit. To the contrary, if the capacity of the EP 7 for one power source is reduced, the economical efficiency is deteriorated since the number of the power sources is increased.

SUMMARY OF THE INVENTION

The present invention has been made in order to solve the above problems, and an object of the present invention is to provide a self-discharge type pulse charging electrostatic precipitator in which back ionization is suppressed to increase the precipitation efficiency while attaining a reduction of the cost of the power source.

In order to achieve the above object, the present invention is structured as follows.

The self-discharge type pulse charging electrostatic precipitator including a high-speed switching element, through which an electrical charge stored in a capacitor is supplied to the electrostatic precipitator and the charge is dissipated by an internal resistance within the electostatic precipitator, is characterized by the provision of means for supplying an electrical charge through the high-speed switching element successively in a time sharing manner to a plurality of divided charging sections which are formed by dividing a charging section of the electrostatic precipitator into a plurality of charging sections energized by one power source and which are coupled with each other through inductive elements, and a charging capacitor having a capacitance selected to be substantially equal to a capacitance of each of the divided charging sections.

(1) The charging section of EP for one self-discharge type pulse generating power source is divided into a plurality of sections, which are coupled with each other through inductors each having an inductance of several hundreds to several thousands of micro henry [μH]. The electrical charge stored in the charging capacitor can be suppied to the respective divided charging sections of EP through the high-speed switching element which is different from the circuit coupled with the inductors.

(2) The capacitance of the charging capacitor of the self-discharge type pulse generating power source and the high-speed switching element is selected to correspond to the capacitance of one section of the multiplicity of divided charging sections.

The operation is as follows.

(1) The circuit element for each charging section is identical with the self-discharge type pulse charging. By dividing the charging section supplied with the same power source into a plurality of sections and coupling the divided charging sections with each other through the inductors each having an inductance of several hundreds to several thousands of micro henry [μH], one charging section supplied with the electrical charge from the charging capacitor of the different circuit can obtain high peak voltage instantaneously from the electrical charge. At the same time, since the electrical charge is moved to other charging sections through the inductors with a small time delay, the attenuation starting voltage in the section supplied with the charge can be reduced and the high peak voltage is obtained while suppressing reverse ionization by suppressing excessive current flowing through EP.

(2) In the charging section supplied with the electrical charge from the charging capacitor, the voltage is merely attenuated from the attenuation starting voltage to the residual voltage by the current flowing through the equivalent resistor $R_{EP}$ until the electrical charge is supplied again in the case of the conventional self-discharge type charging pulse. However, in the present invention, each charging section is supplied with the electrical charge through the inductors while the other charging sections are supplied with the electrical charge successively. Accordingly, the voltage is varied slightly pulsatively and the voltage is then restored to the same level as the attenuation starting voltage of the charging section supplied with the electrical charge.

Accordingly, the maintenance of the average voltage can be improved without the occurrence of back ionization, while the saving of energy can be attained while maintaining the average voltage.

(3) In the conventional self-discharge type pulse charging EP, the power source having the same EP capacity requires a charging capacitor corresponding to the capacitance of EP in order to obtain the high peak voltage, and the switching element is required to turn on and off large current. To the contrary, in the present invention, the substantially identical peak voltage can be obtained by a charging capacitor having the capacitance corresponding to the capacitance of each charging section, and the curent turned on and off by the switching element can be reduced as compared with the current in the prior art.

More particularly, since the charging section supplied with the electrical charge from the charging capacitor and the charging sections not supplied are coupled with each other through the inductors, only the charging section directly supplied with the electrical charge involves increasing potential having a sharp rising edge, and subsequent delivery and receipt of the electrical charge to the other charging sections are effected through the inductors with time delay so that a uniform voltage is obtained. Accordingly, the peak voltage of each charging section can be sufficiently high even if the capacitance of the charging capacitor corresponds to the capacitance of the each charging section.

The present invention possesses the following excellent effects given the above configuration.

(1) The improvement of the voltage waveform of the self-discharge type pulse charging EP forming economical pulse charging means, that is, the improvement of reducing the attenuation starting voltage and increasing the residual voltage maintains the characteristic of obtaining the high voltage pulse having a sharp rising edge for the high resistive dust as it is and obtains the high peak voltage while suppressing reverse ionization. Further, the suppression of reduction of the voltage can improve the maintenance of the average voltage and can obtain a higher precipitation efficiency (refer to FIG. 3).

(2) The capacitance of the charging capacitor of the power source can be reduced greatly, that is, reduced to the capacitance obtained by dividing by the number of charging sections as compared withthe conventional self-discharge type pulse charging EP and the cost of the power source can be reduced. Since the current turned on and off by the high-speed switching element can be reduced greatly, that is, reduced to the value obtained by dividing by the number of charging sections, the reliability can be improved. Generally, the life of a contact of a switch is inversely proportional to the square of the current flowing through the contact.

DETAILED DESCRIPTION OF A PREFERRED EMBODIMENT

Figure 1:
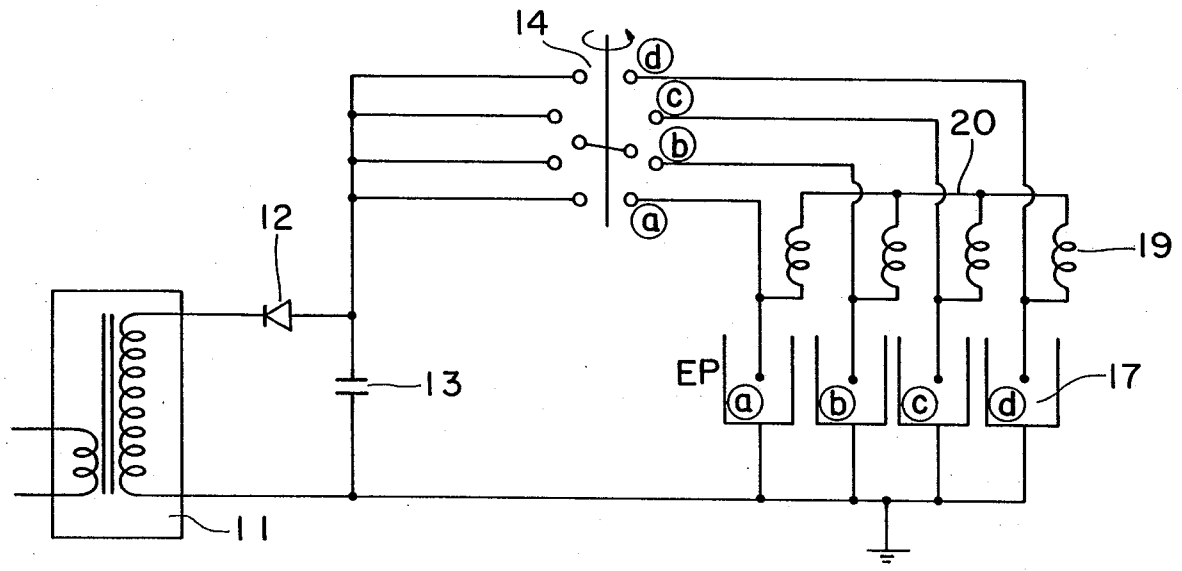
FIG. 1 schematically illustrates an embodiment of the present invention.

Referring to FIG. 1 which shows a schematic of an embodiment of the present invention, a voltage stepped up by a transformer 11 is rectified through a rectifier 12 and is stored in a charging capacitor 13 as an electrical charge. The capacitor 13 is connected through a high-speed switch 14 to an EP 17. The EP 17 is divided into 4 charging sections shown by (a)–(d) in this example and the divided sections are supplied with the electrical charge from a single power source. The number of the divided charging sections may be two or more, but the number of two to six is desirable. The charging sections may include sections in the direction of gas flow, although it is generally desirable to select the charging sections in the direction perpendicular to the gas flow in which the characteristic of current and voltage is identical. While a multi-stage rotary spark gap is used as the high-speed switch in this example, a high-speed and high-voltage type thyristor or other devices may be used.

On the other hand, the charging sections (a)–(d) of the EP 17 are coupled with each other through inductors 19 and a coupling bar 20 having high conductivity.

The capacitance of the charging capacitor may be the capacitance value corresponding to the capacitance of EP in each of the charging sections.

Operation of the embodiment of the present invention is now described in time series manner.

Figure 2:
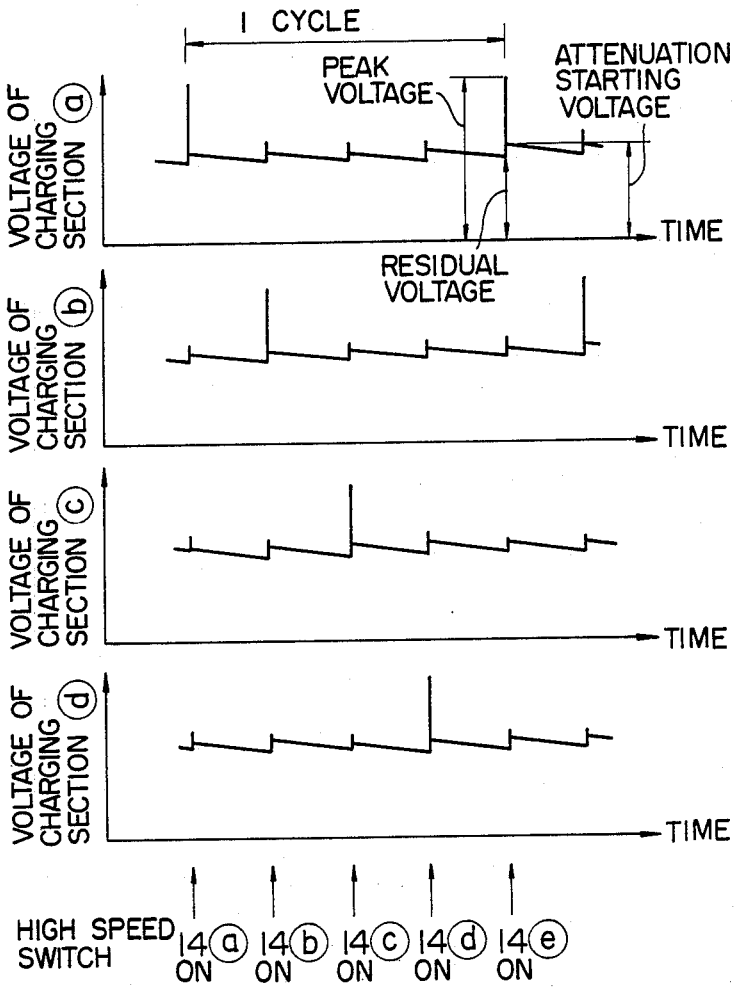
FIG. 2 shows voltage waveforms in the embodiment of FIG. 1.
Figure 3:
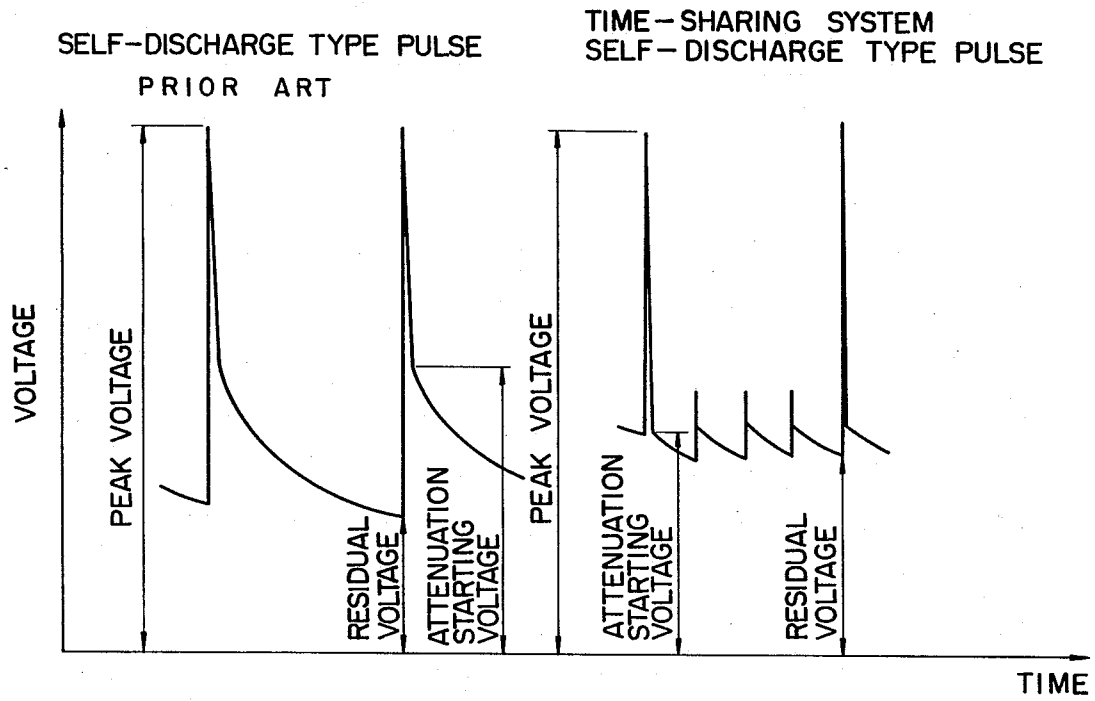
FIG. 3 shows voltage waveforms for the comparison of the pesent invention and the prior art.
Figure 4A:
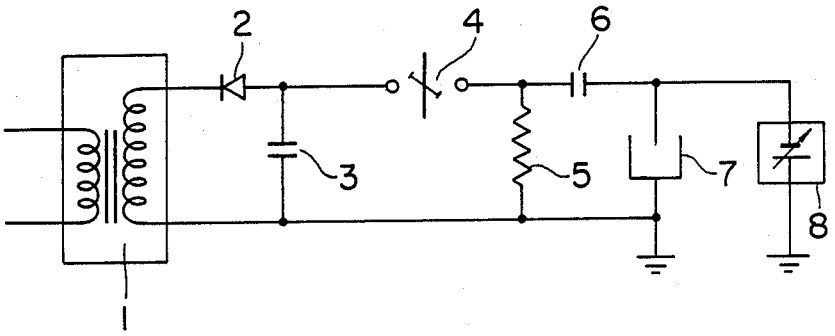
FIG. 4(A) PRIOR ART
FIG. 4 illustrates the prior art.
Figure 4B:
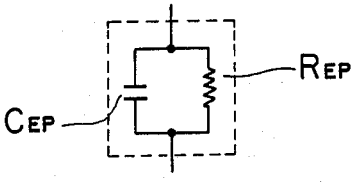
FIG. 4(B) PRIOR ART
Figure 5A:
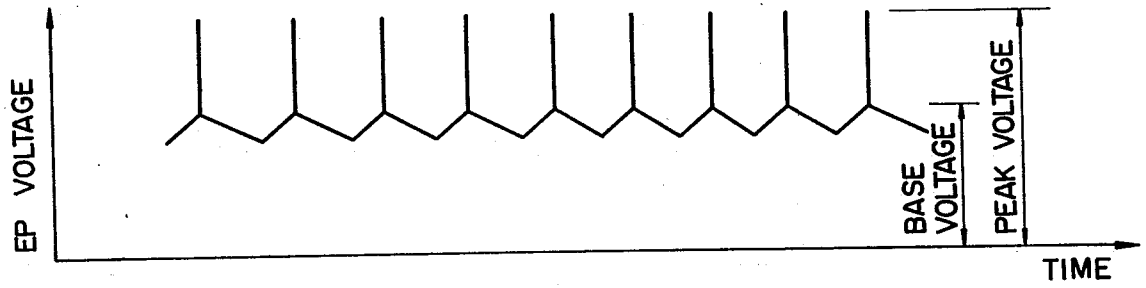
FIG. 5(A) PRIOR ART
FIG. 5 illustrates the prior art.
Figure 5B:
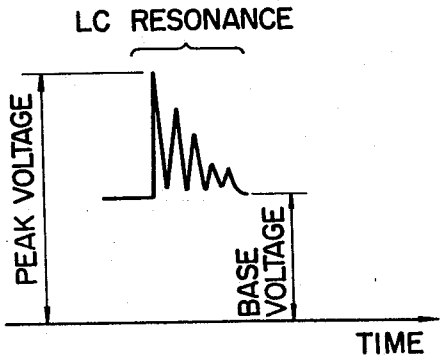
FIG. 5(B) PRIOR ART
Figure 6A:
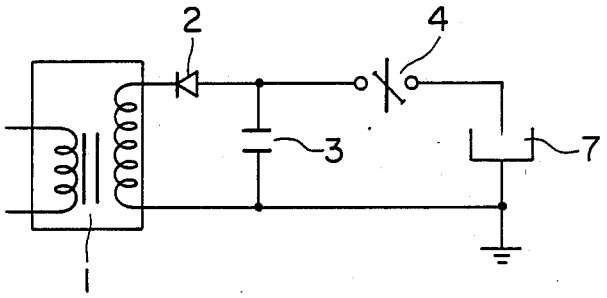
FIG. 6(A) PRIOR ART
FIG. 6 illustrates the prior art.
Figure 6B:
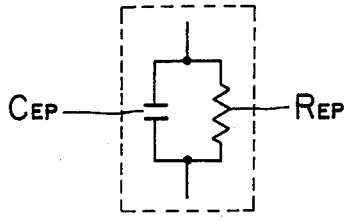
FIG. 6(B) PRIOR ART
Figure 7A:
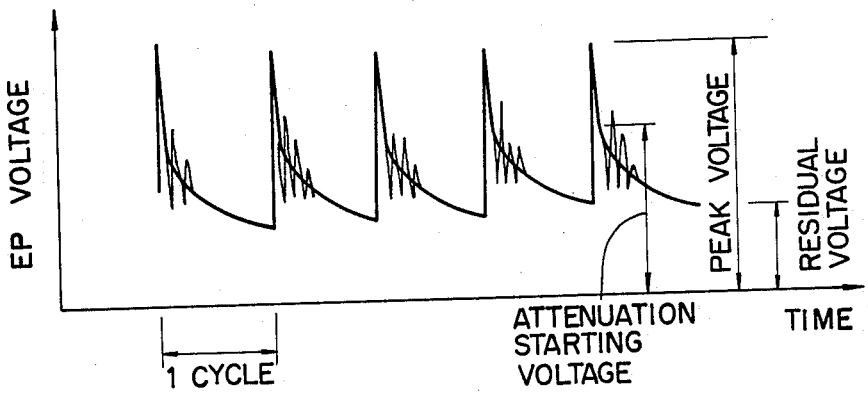
FIG. 7(A) PRIOR ART
FIG. 7 illustrates the prior art.
Figure 7B:
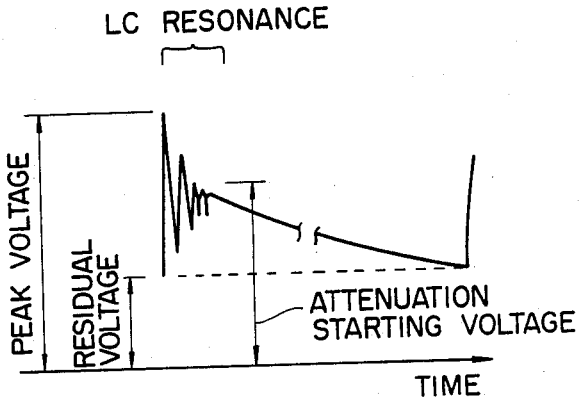
FIG. 7(B) PRIOR ART
Figure 8:
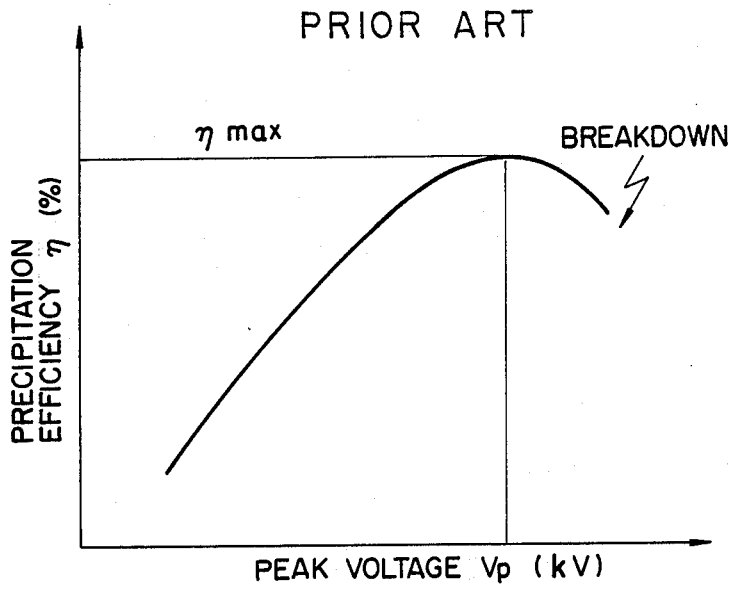
FIG. 8 PRIOR ART
FIG. 8 illustrates the prior art.

FIG. 2 shows voltage waveforms of each of the charging sections when the rotary spark gap is sequentially turned on and off to supply the electrical charge stored in the capacitor 13 to each of the charging sections in the order of sections (a), (b), (c) and (d) in time series manner. When the switch (a) is turned on, the electrical charge is supplied to the charging section (a) of EP 17 from the charging capacitor 13 to effect the LC resonance. At this time, the electrical charge tends to flow into other charging sections through the inductors 19. However, since the increase of the potential having a sharp rising edge containing a high frequency component causes time delay to retard the flow of charge into other charging sections, the peak voltage in the charging section (a) increases to the substantially same level as that in the case where the other charging sections are not connected through the inductors thereto. However, if the value of the inductors 19 is too small, since the leakage current through the inductors 19 is large and the peak voltage is reduced, it is desirable that the inductance of the inductors 19 is more than several hundreds micro henry [$\mu$H].

After the voltage supplied to the charging section (a) reaches the high peak voltage, the delivery and receipt of the electrical charge are actively effected through the inductors 19 among the charging sections. Thus, the voltage level of each of the charging sections is equal to each other while the delivery and receipt of the electrical charge are made by the LC resonance with the equivalent capacitance $C_{EP}$ contained in the section (a) and the total equivalent capacitance $C_{EP}$ of the other charging sections (b), (c) and (d). The voltae at this time is the attenuation starting voltage, and since the electrical charge is, however, dispersed into the charging sections (a), (b), (c) and (d), the voltage in the section (a) is reduced as compared with the single configuration where the sections are not connected with each other through the inductors, whereas the voltage in the other sections (b), (c) and (d) is increased. Subsequently, the electrical charge in the sections (a), (b), (c) and (d) is effectively dissipated by a resistance effect and the like due to the corona discharge in each section and the voltage is attenuated gradually.

Then, the switch for the charging section (b) is turned on and the voltage of the section (b) increases to the high peak value. At this time, the charging section (a) is affected by the peak voltage of the section (b) through the inductor 19 so that peak voltage in the form of a pulse having a rising edge attenuated a little as compared with that of the section (b) appears in the section (a), and the voltage of the section (a) is the same voltage as the attenuation starting voltage of the charging section (b). Thereafter, the same operation is repeatedly made so that the switch is turned on and off for the sections (c) and (d), and the switch is then turned on and off for the section (a).

The operation that the electrical charge stored in one common capacitor is supplied to each of the charging sections during one cycle in time sharing manner is the same operation as that of the time sharing system for a computer. Accordingly, this can be called a time sharing energy supply self-discharge type pulse charging system.

We claim:

1. A self-discharge type pulse charging electrostatic precipitator comprising:

a high speed switching device;

a capacitor, connected to a DC power source, for storing an electrical charge from said DC power source;

a plurality of charging sections, each for receiving said charge through said switching device and dissipating said charge through an internal resisance thereof, said charging sections each having a capacitance value substantially equal to that of said capacitor;

said high speed switching device comprising time sharing switch means for successively connecting each of said charging sections to said capacitor in a time sharing manner;

each of said charging sections being connected across said capacitor through said high speed switching device, said capacitor and high speed switching device being connected to form an energy supply circuit;

an inductive circuit, electrically connected in parallel to said energy supply circuit and said charging sections, said inductive circuit including a plurality of inductors, corresponding in number to said charging sections and connected in common with each other at one end and with a diferent one end of said inductors being connected to each of said charging sections, said inductive circuit suppressing reverse ionization in said charging sections.

2. A self-discharge type pulse charging electrostatic precipitator according to claim 1, wherein the inductance of each said inductive means is several hundreds to several thousands micro henry [$\mu$H].

* * * * *